United States Patent [19]

King

[11] Patent Number: 4,886,368

[45] Date of Patent: Dec. 12, 1989

[54] ROTARY MIXER

[75] Inventor: L. Tony King, Long Beach, Calif.

[73] Assignee: Komax Systems, Inc., Long Beach, Calif.

[21] Appl. No.: 84,839

[22] Filed: Aug. 13, 1987

Related U.S. Application Data

[63] Continuation-in-part of Ser. No. 34,672, Apr. 6, 1987, Pat. No. 4,793,713.

[51] Int. Cl.[4] ..... B01F 7/00; B01F 15/02

[52] U.S. Cl. ..... 366/150; 366/295; 366/302; 366/340

[58] Field of Search ..... 366/150, 173, 244, 245, 366/99, 247, 279, 305, 307, 316, 325, 343, 605, 330, 270, 295, 293, 329, 330, 176, 340; 422/135, 225, 226, 901; 241/45, 152 R, 157

[56] References Cited

U.S. PATENT DOCUMENTS

| | | | |
|---|---|---|---|
| 1,885,283 | 11/1932 | Ostermann | 366/176 X |
| 1,924,080 | 8/1933 | Gram | 366/176 X |
| 3,064,307 | 11/1962 | Sanborn | 141/59 X |
| 3,164,377 | 1/1965 | Cramer, Jr. | 366/293 X |
| 3,321,283 | 5/1967 | Ewald | 366/295 X |

FOREIGN PATENT DOCUMENTS

| | | | |
|---|---|---|---|
| 1532742 | 6/1968 | France | 366/340 |
| 998329 | 7/1965 | United Kingdom | 366/329 |

*Primary Examiner*—Harvey G. Hornsby
*Assistant Examiner*—Scott J. Haugland
*Attorney, Agent, or Firm*—Limbach, Limbach & Sutton

[57] ABSTRACT

A mixing device for the mixing of two or more liquids. A shell body is configured with a cavity having a longitudinal axis and circular cross-section which rotatably houses a shaft. The shaft is configured along a portion of its surface with grooves for receiving liquids to be mixed from inlets located within the shell body. A narrow annular gap region is formed between the outer surface of the shaft and the inner surface of the internal cavity in that portion of the shaft containing the slotted grooves.

9 Claims, 1 Drawing Sheet

ROTARY MIXER

The present application is a continuation-in-part of U.S. application Ser. No. 34,672 filed on Apr. 6, 1987 now U.S. Pat. No. 4,793,713.

TECHNICAL FIELD OF THE INVENTION

The present invention deals with a mixing device for the mixing of two or more liquids. The device has been configured to improve the quality of mixing by maximizing the scale and intensity of mixing of the components to be mixed.

BACKGROUND OF THE INVENTION

Mixing is a term applied to actions which reduce non-uniformities of materials involved. Such materials can be liquids, solids or gases, and the non-uniformities in such materials can occur in various properties, such as color, density, temperature, etc. The quality of mixing can be described by two characteristics—scale ("S") and intensity ("I"). The scale of mixing is the average distance between the centers of maximum difference in a given property of the mixture, and intensity is the variation in a given property of the mixture.

The terms "S" and "I" are easily understood by the following illustrations. Assume that in a shallow dish of white paint, a number of randomly dropped dollops of viscous black paint have been applied. Where all black paint within a dollop resides, the intensity "I" is one hundred percent. In regions of white paint the intensity is zero percent. The distance between the center of the black dollop and an adjacent white region is called the scale of mixing.

If the dish of paint were allowed to sit untouched, the demarkation between black and white would begin to blur as the peak or one hundred percent intensity of the black paint diminishes, and the zero intensity of the white paint rises. Finally, when enough time has passed, the intensity variation will asymptote to zero, and a uniformly gray paint mixture will result. Obviously, the smaller the scale of mixing, the more rapidly will the intensity variation asymptote to zero. Conversely, the higher the molecular diffusion, the larger the scale of mixing can be in achieving a given degree of mixedness for a given time period. Generally speaking, the higher the viscosity of a fluid, the lower will be its rate of molecular diffusion in any given solvent.

As design goals in producing the mixture of the present invention, it was the intent to reduce the scale of mixing rapidly, and thus promote a rapid drop in intensity.

The principles outlined above have particular application in the mixing of special polymers which are used in water treatment applications. These polymers are usually supplied having viscosities that can range from a few thousand centipoise to the order of one million centipoise. The polymers are generally diluted on site to save shipping costs and injected and mixed with the water to be treated as they cause particulates in water to agglomerate to form what is called "floc,"which can then be filtered.

Obviously, such high viscosity polymers are difficult to dilute on site. The conventional mechanical mixing approach, consisting of a motor driven paddle or blade in a tank, is clumsy, inefficient, and ineffective. Large lumps of undiluted polymer can circulate for hours or even days without being dissolved into solution. In addition, the very high shear rates associated with the tips of the blades can damage shear-sensitive polymers by breaking up the long chain polymers and reducing the flocculation efficiency. This is particularly true for emulsion polymers.

Even though such special polymers used in water treatment applications are introduced to, for example, ten times their own volume of water, the mixture will have a much higher viscosity than the original, undiluted matter—often ten to fifty times higher. Typical dilution ratios are 200:1. In examining this problem, it became obvious that an appropriate mixing system would be one which would break up the water/-polymer elements into very small components so as to achieve a minimum scale of mixing. It was also recognized that the appropriate mixing system should be one which could provide for controlled shearing to cause a smearing of the elements together. This aids in molecular diffusion by increasing the interfacial area and by reducing interfacial thickness. It was obviously a design goal to accomplish this result in the shortest amount of time, preferably in the order of one second or less.

Parent U.S. application Ser. No. 34,672 disclosed a device for the mixing of two or more liquids which was particularly effective in mixing such things as those water treatment polymers discussed previously. The device in the prior application consisted of the use of a hollow shaft connected to a drive motor which would cause the shaft to rotate. A shell body was employed to house the rotatable shaft, such shell body having inlets for the liquids to be mixed approximate one end thereof. Slotted grooves were configured within the hollow shaft for receiving the liquids to be mixed from the inlets located within the shell body. A narrow annular gap region was formed between the outer surface of the hollow shaft and the inner surface of the shell body. A first set of holes was configured in the hollow shaft located downstream of the narrow annular gap region for the introduction of the liquids into the interior of the hollow shaft. A second set of grooves configured in the hollow shaft located downstream from the first set of holes was used for dispensing the liquids from the interior of the hollow shaft and through the shell body.

Although the invention disclosed and claimed in parent U.S. application Ser. No. 34,672 represented a marked advance in the art, the channeling of the liquids to be mixed through the annular gap region and within the hollow shaft resulted in significant pressure drops being measured across the mixing device. It has now been found that a similar mixing device can be configured displaying virtually all of the beneficial characteristics of the device disclosed in the parent application while exhibiting significantly reduced pressure drops.

SUMMARY OF THE INVENTION

The present invention deals with a device for the mixing of two or more liquids. The device comprises a shell body having upstream and downstream ends and an internal cavity, said cavity having a longitudinal axis and substantially circular cross-section. The shaft is rotatably housed within the shell body which itself has a longitudinal axis which coincides with the longitudinal axis of the internal cavity. The shaft possesses slotted grooves configured along a portion of its surface for receiving the liquids to be mixed from inlets located within the shell body.

A narrow annular gap region is formed between the outer surface of the shaft and the inner surface of the internal cavity in that portion of the shaft containing the slotted grooves. A drive shaft for connection to a suitable device for rotating the shaft within the internal cavity is provided.

Inlet means are located within the shell body for the introduction of two or more liquids to be mixed proximate the upstream end of the shell body. A liquid exit means is located proximate the downstream end of the shell body for removing the two or more liquids after mixing.

In operation, the slotted grooves located in the shaft capture the liquids entering the shell body. The liquids are then caused to travel down the grooves toward the annular gap region due to the hydraulic pressure imposed on the liquids at inlet. As an optional expedient, to improve the hydraulic flow of the liquids through the device, an impeller can be provided on the drive shaft.

DETAILED DESCRIPTION OF THE INVENTION

Figure 1:
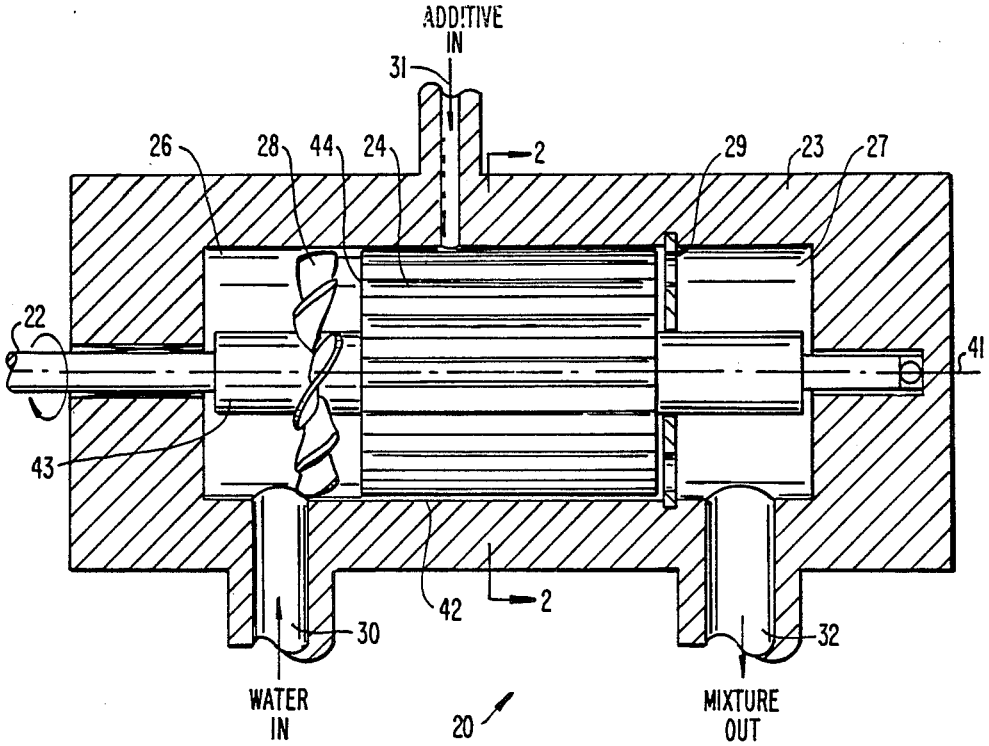
FIG. 1 represents a partial cross-sectional view of the mixing device of the present invention.

Turning first to FIG. 1, the basic mixing device of the present invention as shown is element 20. Drive shaft 22 can be coupled to a suitable drive motor. For most applications, drive motors in the size range of 0.1–1.0 horsepower have been found to be adequate.

Outer shell 23, which can comprise a cast or forged metal housing, is provided with inlets 30 and 31 for introducing the liquids to be mixed. As an optional expedient, a pump (not shown) can be provided coupled to drive shaft 22 for introducing the polymer component in a polymer/water two-component system. When a pump is employed, the more viscous liquid such as the polymer component in the polymer/water two-component system would be introduced by the pump and would enter inlet 31 as shown in FIG. 1.

Figure 2:
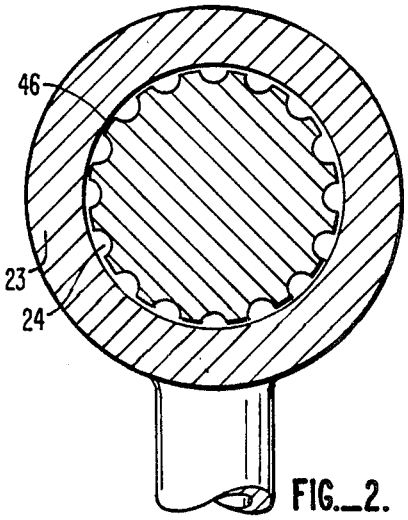
FIG. 2 represents a cross-sectional view along lines 2—2 of FIG. 1.

Turning again to FIG. 1, shell 23 is provided with internal cavity 42, said cavity having a longitudinal axis 41 and substantially circular cross-section as shown generally in FIG. 2.

Rotatable shaft 43 is provided with a longitudinal axis which substantially coincides with longitudinal axis 41 of internal cavity 42. The rotatable shaft is provided with section 44 which possesses slotted grooves 24 for receiving liquids to be mixed from inlets 30 and 31.

A narrow annular gap region is formed between the outer surface of the shaft and the inner surface of the internal cavity in shaft portion 44 as best shown by FIG. 2. More specifically, grooves 24 are shown as substantially semi-circular indents within the rotatable shaft where an annular gap is shown to appear between the perimeter of the rotatable shaft in area 44 at surface 46 which forms at the periphery of the rotatable shaft between grooves 24 and the inner surface of shell body 23.

As the liquids are introduced, a drive motor (not shown) causes the shaft 22 to rotate and the result is the introduction of bands of the viscous component into a contiguum of the low viscosity component into slotted grooves 24. The hydraulic pressure imposed at inlets 30 and 31 causes the liquids to progress down the slotted grooves from left and right toward cavity 27. In light of the fact that very little clearance in the range of five-one-thousandth of an inch is provided between peripheral surface 46 and the surface of cavity 42, the liquids tend to smear thus providing an improved scale of mixing (S).

In this preferred embodiment, a first liquid such as water enters inlet means 30 and occupies region 26 which is a volume formed by providing shaft 43 of reduced cross-section within cavity 42. This first liquid then enters grooves 24 and is mixed with a first additive such as a water treatment polymer which is introduced via inlet means 31.

In the event that insufficient hydraulic pressure exists at first liquid inlet 30, an impeller 28 can be provided on shaft 43 which turns with the rotation of the drive shaft having an effect of increasing the upstream hydraulic pressure forcing the liquids down grooves 24.

Figure 3:
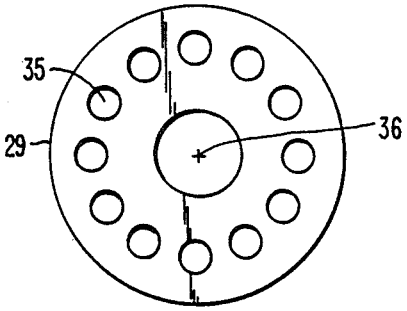
FIG. 3 is a plan view of a circular plate located downstream of the slotted groove region of the rotatable shaft employed as a preferred embodiment in practicing the present invention.

A similar cavity can be provided downstream of annular groove region 44 which is shown in FIG. 1 as volume 27. Upon reaching volume 27, virtually all of the mixing has taken place. As a further optional expedient, a substantially circular plate 29 can be provided as shown in FIGS. 1 and 3 having a geometric center 36 which substantially coincides with longitudinal axis 41. This circular plate contains circumferentially disposed openings 35. Holes 35 should ideally be larger in diameter than the diameters of grooves 24. When circular plate 29 is employed, it acts to "chop" liquids emanating from narrow annular gap region 44 to further enhance mixing.

In view of the foregoing, modifications of the disclosed embodiments within the spirit of the invention will be apparent to those of ordinary skill in the art. The scope of the invention is therefore to be limited only by the appended claims.

I claim:

1. A mixing device for the mixing of two or more liquids comprising a shell body having upstream and downstream ends and an internal cavity, said cavity having a longitudinal axis and substantially circular cross section, a shaft rotatably housed within said shell body and having a longitudinal axis which coincides with said longitudinal axis of said internal cavity, said shaft having slotted grooves configured along a portion of its surface for receiving the liquids to be mixed from inlets located within the shell body, a narrow annular gap region formed between the outer surface of the shaft and the inner surface of the internal cavity in the portion of the shaft containing said slotted grooves such that said liquids tend to smear in said narrow angular gap region, a drive shaft for connection to a suitable device for rotating said shaft within said internal cavity and inlet means located within said shell body for the introduction of two or more liquids to be mixed proximate the upstream end of said shell body and a liquid exit means located proximate the downstream end of said shell body for removing said two or more liquids.

2. The mixing device of claim 1 wherein said shaft is provided with a region of reduced cross section located upstream of said narrow annular gap region, said region of reduced cross section forming an upstream volume within said internal cavity.

3. The mixing device of claim 2 wherein a first liquid inlet is located within said shell body at said upstream volume.

4. The mixing device of claim 2 wherein a second liquid inlet is located within said shell body at said narrow annular gap region.

5. The mixing device of claim 2 wherein an impeller is located on said shaft within said upstream volume to increase hydraulic pressure on the liquids to be mixed causing the liquids to travel down said grooves towards the downstream end of said shell body.

6. The mixing device of claim 1 wherein said shaft is provided with a region of reduced cross section located downstream of said narrow annular gap region, said region of reduced cross section forming a downstream volume within said internal cavity.

7. The mixing device of claim 6 wherein said liquid exit means comprises an orifice in said shell body at said downstream volume.

8. The mixing device of claim 6 which further comprises a substantially circular plate located within said downstream volume having a geometric center which substantially coincides with the longitudinal axis of said shaft having openings formed therein for the passage of said two or more liquids to be mixed prior to the passage of said two or more liquids through said liquid exit.

9. The mixing device of claim 1 wherein the clearance between the outer surface of the shaft and the inner surface of the internal cavity forming the narrow angular gap region is approximately five-one-thousandths of an inch.

* * * * *